US009105460B2

(12) United States Patent
Wilken et al.

(10) Patent No.: US 9,105,460 B2
(45) Date of Patent: Aug. 11, 2015

(54) GAS DISCHARGE TUBE INCLUDING A STARTING AID

(71) Applicant: OSRAM GmbH, Munich (DE)

(72) Inventors: Ludger Wilken, Berlin (DE); Dieter Schmidt, Witten (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 14/249,394

(22) Filed: Apr. 10, 2014

(65) Prior Publication Data

US 2014/0354147 A1 Dec. 4, 2014

(30) Foreign Application Priority Data

May 29, 2013 (DE) ..... 10 2013 210 117

(51) Int. Cl.
*H01J 61/54* (2006.01)
*H01J 61/36* (2006.01)

(52) U.S. Cl.
CPC ..... *H01J 61/547* (2013.01); *H01J 61/366* (2013.01)

(58) Field of Classification Search
CPC ..... H01J 61/547; H01J 61/54
USPC ..... 313/594
See application file for complete search history.

(56) References Cited

U.S. PATENT DOCUMENTS 8,531,106 B2 9/2013 Demmert et al.
2011/0115371 A1 * 5/2011 Steere et al. ..... 313/594

FOREIGN PATENT DOCUMENTS

DE 102010062903 A1 6/2012

* cited by examiner

*Primary Examiner* — Anne Hines

(57) ABSTRACT

In various embodiments, a gas discharge tube having a starting aid may include a discharge vessel with at least one open end, in which end a stopper with a continuous stopper bore is inserted; and an electrical leadthrough, which is inserted into the respective stopper bore and is fuse-sealed into the stopper bore. The starting aid extends as far as into the stopper bore.

17 Claims, 7 Drawing Sheets

GAS DISCHARGE TUBE INCLUDING A STARTING AID

CROSS-REFERENCE TO RELATED APPLICATION

This application claims priority to German Patent Application Serial No. 10 2013 210 117.1, which was filed May 29, 2013, and is incorporated herein by reference in its entirety.

TECHNICAL FIELD

Various embodiments relate generally to a gas discharge tube including a starting aid, having a discharge vessel with at least one open end, in which end a stopper with a continuous stopper bore is inserted, and an electrical leadthrough, which is inserted into the respective stopper bore and is fuse-sealed into the stopper bore. Various embodiments also relate to a gas discharge lamp which has at least one such gas discharge tube. Various embodiments may be applied e.g. to sodium and metal-halide high-pressure discharge lamps.

BACKGROUND

In the case of a sodium high-pressure lamp and in the case of a metal-halide high-pressure discharge lamp, a starting voltage can be significantly reduced by an electrical connection of a starting aid to an electrode.

DE 10 2010 062 903 A1 discloses a high-pressure discharge lamp including a ceramic discharge vessel, including two electrodes, to which leadthroughs are attached toward the outside, wherein the leadthroughs are fuse-sealed in the end of the discharge vessel by means of glass solder, and including a starting aid which is in the form of a hybrid antenna, which hybrid antenna has at least two rings around the discharge vessel and a connecting strip connecting these rings, wherein on one side, a connecting part of the starting aid as far as to a leadthrough is formed, wherein the center between a leadthrough and an extension limits a nonreactive resistance between the leadthrough and the hybrid antenna to preferably at most 10 kiloohms, preferably to at most 100 ohms. The leadthroughs are guided through a bore ("stopper bore") of a respective stopper, which stopper has been inserted into a respective open end of the discharge vessel. In particular, said document discloses that the connecting part ends in an end piece, preferably in the form of a ring, circular ring or section, also referred to as part-circle, thereof. The end piece runs on an outer end-side stopper surface of the stopper, is spaced apart from the leadthrough there and preferably surrounds the leadthrough at least partially. In particular, the spacing is at most twice as great, preferably at most as great as the diameter of the leadthrough.

In order to produce a high-pressure discharge lamp in accordance with DE 10 2010 062 903 A1, the leadthrough needs to be completely sunk into the associated stopper bore when the glass solder is hot in order to produce an electrical contact with the, for example, ring-shaped end piece of the stopper surface. In practice, however, there are leadthroughs which do not sink completely into the stopper bore, for example owing to canting in the stopper bore. There are likewise stopper bores with an excessively large diameter, in which case the associated leadthroughs sink too far into said stopper bores. Protruding leadthroughs and leadthroughs which are sunk into the bore are both not capable of producing electrical contact with the end piece on the stopper surface.

SUMMARY

In various embodiments, a gas discharge tube having a starting aid may include a discharge vessel with at least one open end, in which end a stopper with a continuous stopper bore is inserted; and an electrical leadthrough, which is inserted into the respective stopper bore and is fuse-sealed into the stopper bore. The starting aid extends as far as into the stopper bore.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
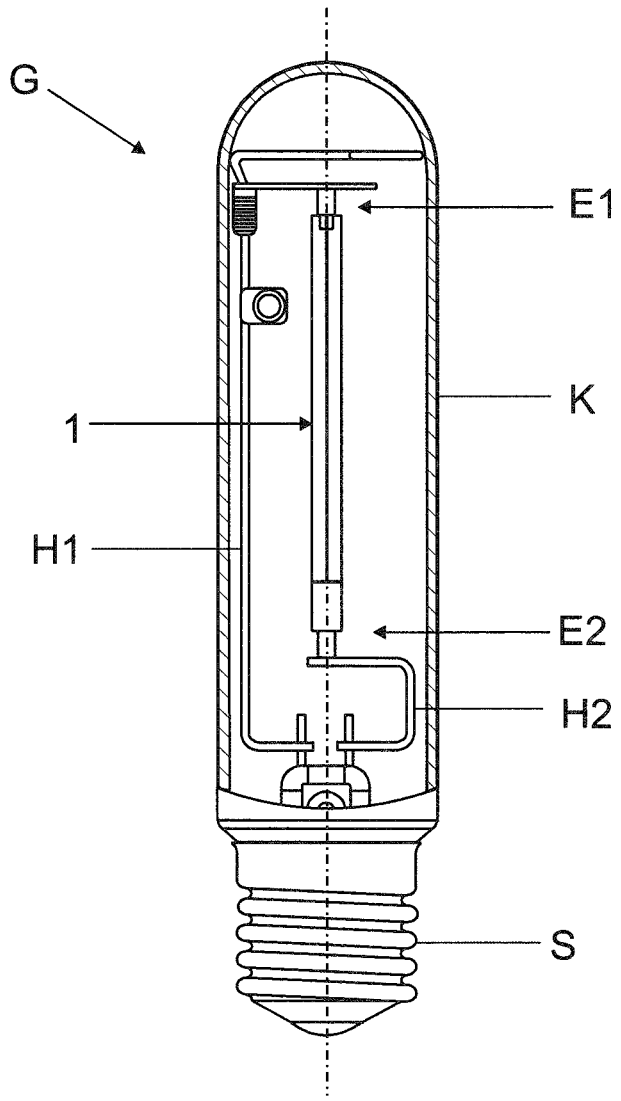
FIG. 1 shows a sectional illustration in a side view of a gas discharge lamp with a high-pressure gas discharge tube.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

Various embodiments may at least partially overcome the disadvantages of the prior art and may provide a more reliable possibility for producing electrical contact between a starting aid and a leadthrough of a gas discharge tube, specifically of the type in question.

Various embodiments provide a gas discharge tube including a starting aid having a discharge vessel with at least one open end, in which end a stopper with a continuous stopper bore is inserted, and having an electrical leadthrough, which is inserted into the respective stopper bore and is fuse-sealed into the stopper bore. In addition, the starting aid extends as far as into the stopper bore.

As a result, a protruding leadthrough or a leadthrough which is sunk into the stopper bore at a slight angle and/or on one side during a fuse-sealing process can also make safe contact with the starting aid, to be precise in the interior or on a surface of the stopper bore. Thus, in a simple, convertible manner, more reliable electrical contact is produced between the leadthrough and the starting aid.

The gas discharge tube is e.g. a sodium or a metal-halide high-pressure discharge lamp. The discharge vessel contains e.g. a fill including metal halide, mercury, metal iodide, amalgam (for example sodium amalgam) and/or sodium and possibly a starting gas consisting of xenon and/or argon. However, all other types of gas discharge tubes are also usable.

A development consists in that the leadthrough is a cylindrical leadthrough, e.g. in the form of a circular cylinder, for example a tube or a pin. The circular leadthrough may e.g. have an outer face which is stepped at least along a longitudinal extent or a ring ("bulge"), as a result of which a stop can be formed against the stopper. The step may have at least one cutting edge. The leadthrough may e.g. consist of a material having a similar coefficient of expansion to aluminum oxide and a sufficiently high melting point, e.g. niobium or at least with niobium as the main constituent. The leadthrough may e.g. be present as a niobium tube.

The leadthrough may e.g. be fuse-sealed into the associated stopper, for example by means of glass solder.

The starting aid may in particular be in the form of a hybrid antenna.

A development consists in that the discharge vessel is a ceramic discharge vessel, e.g. consisting of a transparent ceramic. The ceramic may include, for example, aluminum oxide as the main constituent, e.g. in the form of a polycrystalline aluminum oxide ceramic (PCA). The ceramic may be a doped ceramic, for example doped with magnesium oxide, MgO, zirconium oxide, $ZrO_2$, and/or yttrium oxide, $Y_2O_3$. The ceramic may e.g. be a sintered ceramic, specifically a densely sintered ceramic. Densely sintered aluminum oxide may be provided as the main constituent or as base material with magnesium oxide, zirconium oxide and yttrium oxide as dopants. Alternatively, the discharge vessel can consist of quartz glass.

The discharge vessel can be open at one or two ends. In the case of a discharge vessel which is open at one end, the single open end is closed by the above arrangement. In the case of a discharge vessel which is open at two ends, only one side can be closed by means of the stopper and the leadthrough, or both sides can be closed by means of a respective stopper and an associated leadthrough. In the case of two open ends which are each closed in this way, the starting aid is e.g. electrically connected only to one of the leadthroughs.

The shape of the discharge vessel is in principle not limited and may be at least sectionally linear, e.g. continuously linear, and/or at least sectionally curved, e.g. in the form of a U. The discharge vessel may have a cross section which is identical in size, e.g. identical, over its longitudinal extent; alternatively, it can have a changing cross section, for example a widened or expanded portion.

A further development consists in that the starting aid is arranged at least partially on the outside of the discharge vessel and in particular at least partially consists of so-called "cermet". A cermet can be understood in particular to mean a metal/ceramic mixture which is electrically conductive and can be sintered together with the discharge vessel. The cermet can have, for example, a mixture of aluminum oxide and tungsten.

A development consists in that at least the connecting part of the starting aid is present as a metal plating.

One configuration consists in that the starting aid has at least one starting strip running to the outside of the discharge vessel and, on one side, a connecting part of the starting aid is formed from the starting strip as far as into the stopper bore. As a result, the at least one starting strip is electrically connected to one of the leadthroughs. The connecting part can be in the form of an extension strip.

A development consists in that the starting strip has at least one ring running around the discharge vessel. A further development consists in that the starting aid has at least two rings running around the discharge vessel and a connecting strip connecting these rings. However, the shape of the starting strip is not restricted to this and the starting strip can also be in the form of a surface, for example in the form of a rectangle, for example with a side length of 2 mm×2 mm.

A development consists in that for application of the starting aid, e.g. the connecting part, a type of ink is used. This may have the effect that the region of the connecting part within the stopper bore can be applied in a simple manner with a defined depth in the stopper bore.

A further configuration consists in that the starting aid has a first region, which runs in the form of a ring sector around the stopper bore on an outer end face of the stopper, which first region is adjoined by at least one second region located in the stopper bore. Thus, a particularly secure connection between the first region and the second region may be produced, to be precise even when the rim of the stopper bore is partially exposed. The first region can surround the stopper bore completely in the form of a ring in order to provide a particularly secure connection. However, the first region can in principle also be a region which does not completely surround the stopper bore, for example only surround a sector of less than 360°.

A further configuration consists in that the first region covers the full area of the outer end face of the stopper, which enables an even more secure electrical connection and/or simplifies production, for example owing to the use of areal printing or spraying methods without a template.

A further configuration consists in that the starting aid or the second region thereof of the connecting part extends in the form of a tube into the stopper bore. This facilitates production and enables secure, directionally independent contact to be made with the leadthrough in the stopper bore. However, the second region can also be structured for example by means of lines or tracks running longitudinally and/or transversely in the stopper bore and spaced apart from one another in the circumferential direction or in the longitudinal direction.

A preferred configuration for particularly secure contact-making consists in that the starting aid extends over the entire length of the stopper bore. Therefore, the stopper bore can be occupied in particular completely with the second region of the connecting part of the starting aid.

A preferred configuration for further secure contact-making which is simple to produce consists in that the starting aid extends over no more than 50% of a length of the stopper bore, e.g. no more than 25% of a length of the stopper bore, e.g. over no more than 10% of a length of the stopper bore.

A preferred configuration for the same purpose consists in that the starting aid extends into the stopper bore by no more than 0.5 mm, e.g. no more than 0.3 mm.

Another configuration consists in that a thickness of the starting aid in the stopper bore has a value in the range of from one (1) to thirty (30) micrometers, e.g. in the range of from five (5) to fifteen (15) micrometers and e.g. in the range from eight (8) to twelve (12) micrometers (including the limit values). The thickness of the starting aid may therefore e.g. be eight or twelve micrometers. Such a thickness or thickness range enables a sufficiently low electrical resistance for effective electrical connection and can be achieved by the use of ink.

A configuration consists in that at least the connecting part has such a thickness, possibly also the entire starting aid. The thickness can in particular also apply to curved sections and/or edges of the starting aid, specifically of the connecting part.

Various embodiments also provide a gas discharge lamp which has at least one gas discharge tube as described above.

A development consists in that the gas discharge lamp has a ballast. The ballast can be interposed, e.g. between the gas discharge tube and the electrical contacts (for example an Edison base or a bipin base) of the gas discharge lamp.

FIG. 1 shows a sectional illustration in a side view of a gas discharge lamp G including a high-pressure gas discharge tube 1. The gas discharge lamp G has an electrical connection in the form of an Edison base S. A transparent bulb K rests on the Edison base S. The high-pressure gas discharge tube 1 is accommodated in the bulb K. The high-pressure gas discharge tube 1 is connected at both of its end regions E1 and E2 via electrical contact holders H1 and H2 to the Edison base S. The gas discharge lamp G can have a ballast (not depicted).

Figure 2:
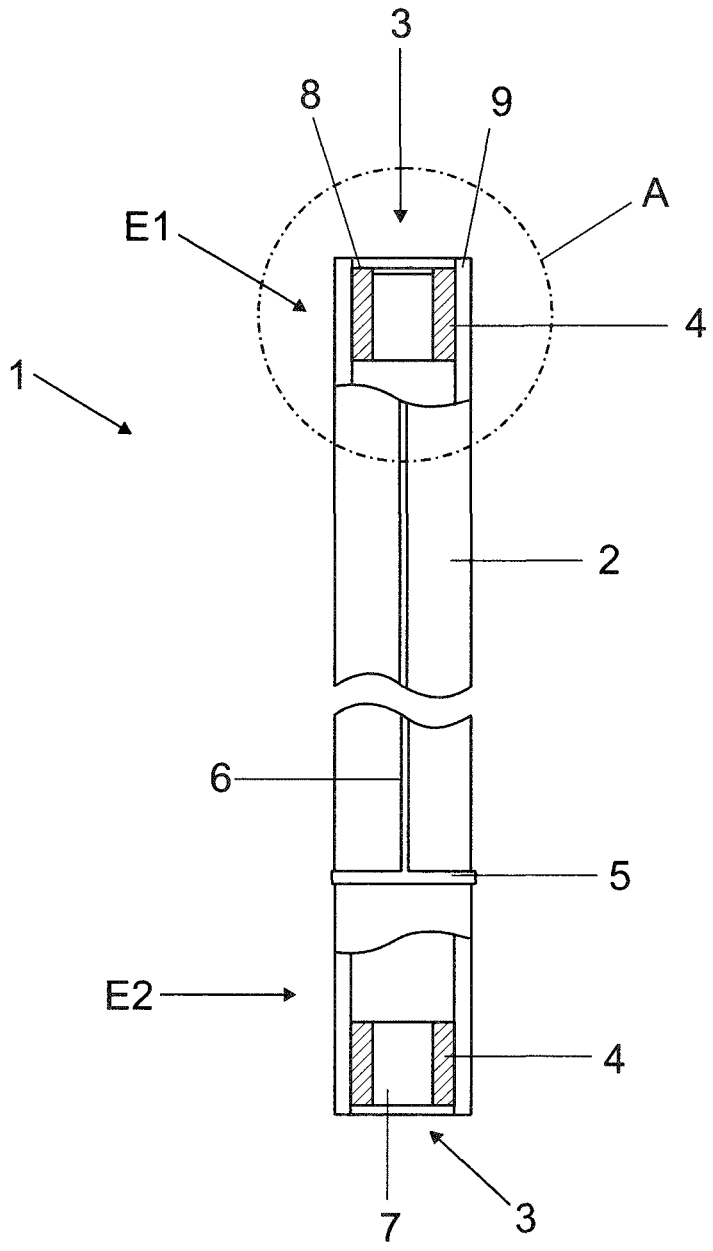
FIG. 2 shows a side view of a detail from the high-pressure gas discharge tube with cut-open end regions, in which as yet there are no leadthroughs.

FIG. 2 shows a side view of a detail of the high-pressure gas discharge tube 1 with cut-open end regions E1 and E2. The high-pressure gas discharge tube 1 has a tubular discharge vessel 2 filled with gas. The gas may include e.g. starting gas such as argon and/or xenon and a fill of sodium, sodium amalgam, mercury and/or metal iodides. The discharge vessel 2 in this case consists of a densely sintered polycrystalline aluminum oxide (PCA), to which magnesium oxide, zirconium oxide and yttrium oxide have been added as dopants. The discharge vessel 2 has in each case one open end 3 at each of its two end regions E1 and E2, into which open end a stopper 4 has been inserted in each case.

A starting strip in the form of an electrically conductive ring 5 consisting of cermet is sintered to an outer side of the discharge vessel 2 between the end regions E1 and E2, which starting strip surrounds the discharge vessel 2 in the form of a ring. The ring 5 is connected to a connecting part 6, which connecting part 6 leads to one of the end regions, in this case the end region E1. The ring 5 and the connecting part 6 form a starting aid 5, 6 and have been produced integrally, for example as a print. The connecting part 6 can at least sectionally likewise act as a starting strip.

The cylindrical stoppers 4 likewise consist of PCA ceramic and have been completely inserted into the open ends 3 of the discharge vessel 2, with the result that the open ends 3 protrude beyond the respective stopper 4. An outer end face 8 of the stopper 4 is therefore beneath a ring-shaped end face 9 of the discharge vessel 2. The stoppers 4 each have a central stopper bore 7, which extends in the longitudinal extent of the discharge vessel 2. The stopper bore 7 can be closed by means of an electrically conductive leadthrough 10, as is described in more detail in the following figures with reference to the detail A with the associated end region E1.

Figure 3:
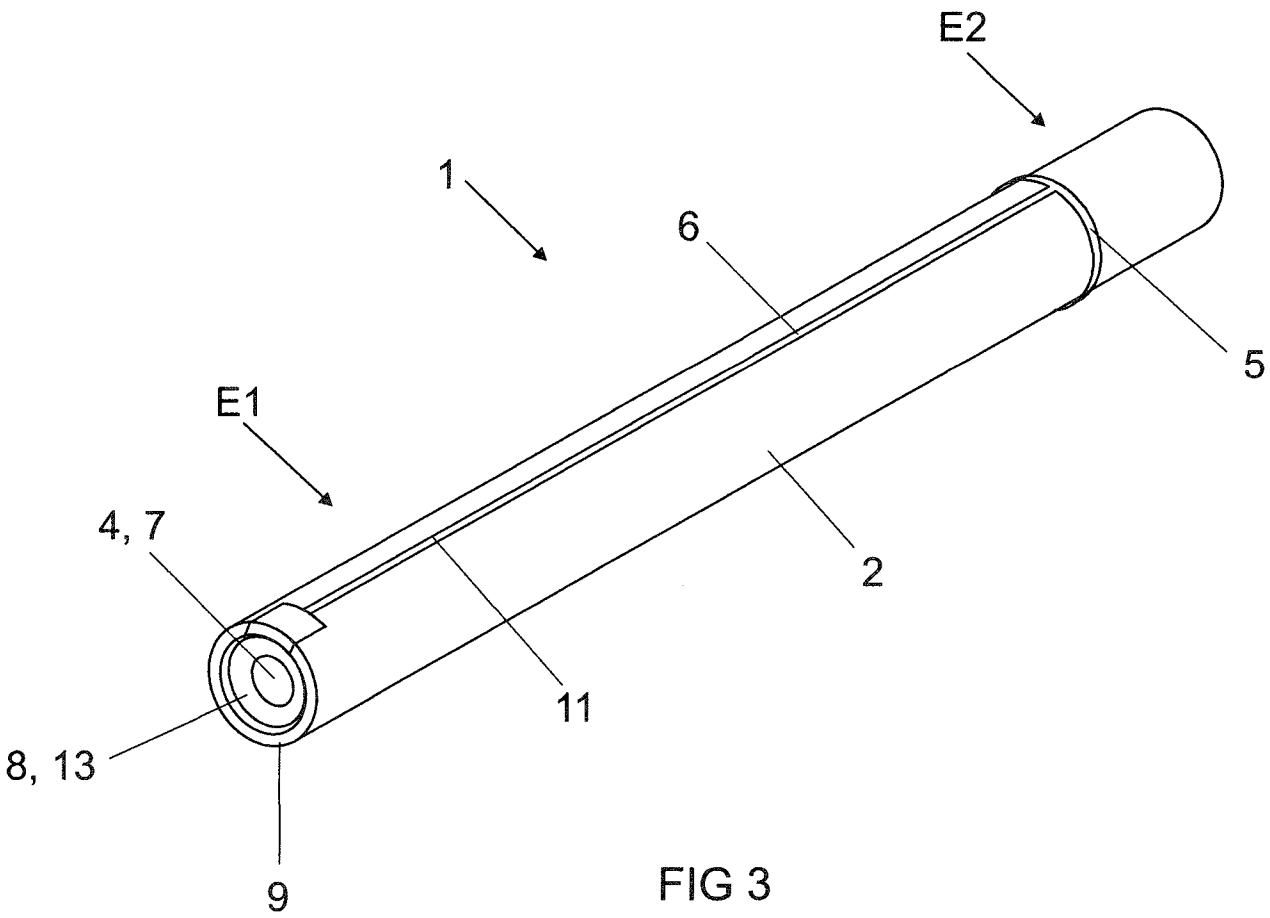
FIG. 3 shows an angled view of the high-pressure gas discharge tube in accordance with a first embodiment.
Figure 4:
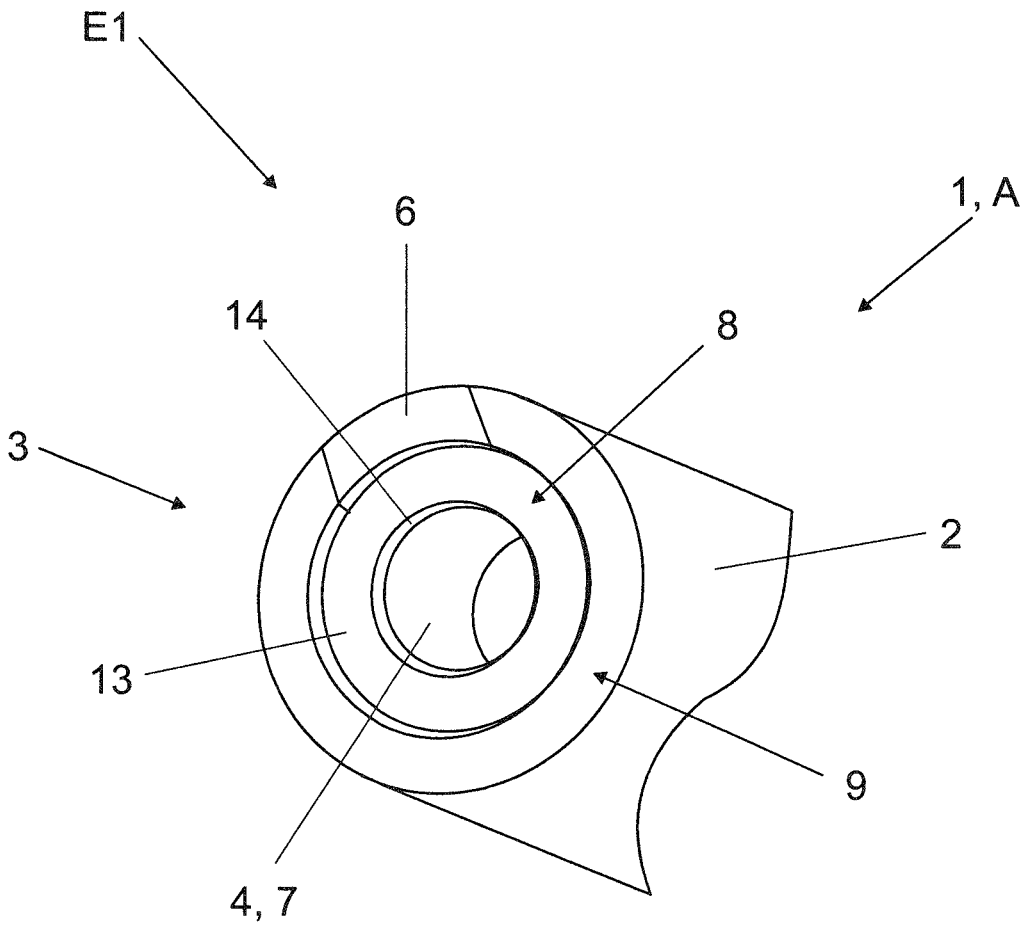
FIG. 4 shows a view from the front at an angle of the end region of the high-pressure gas discharge tube in accordance with the first embodiment.
Figure 5:
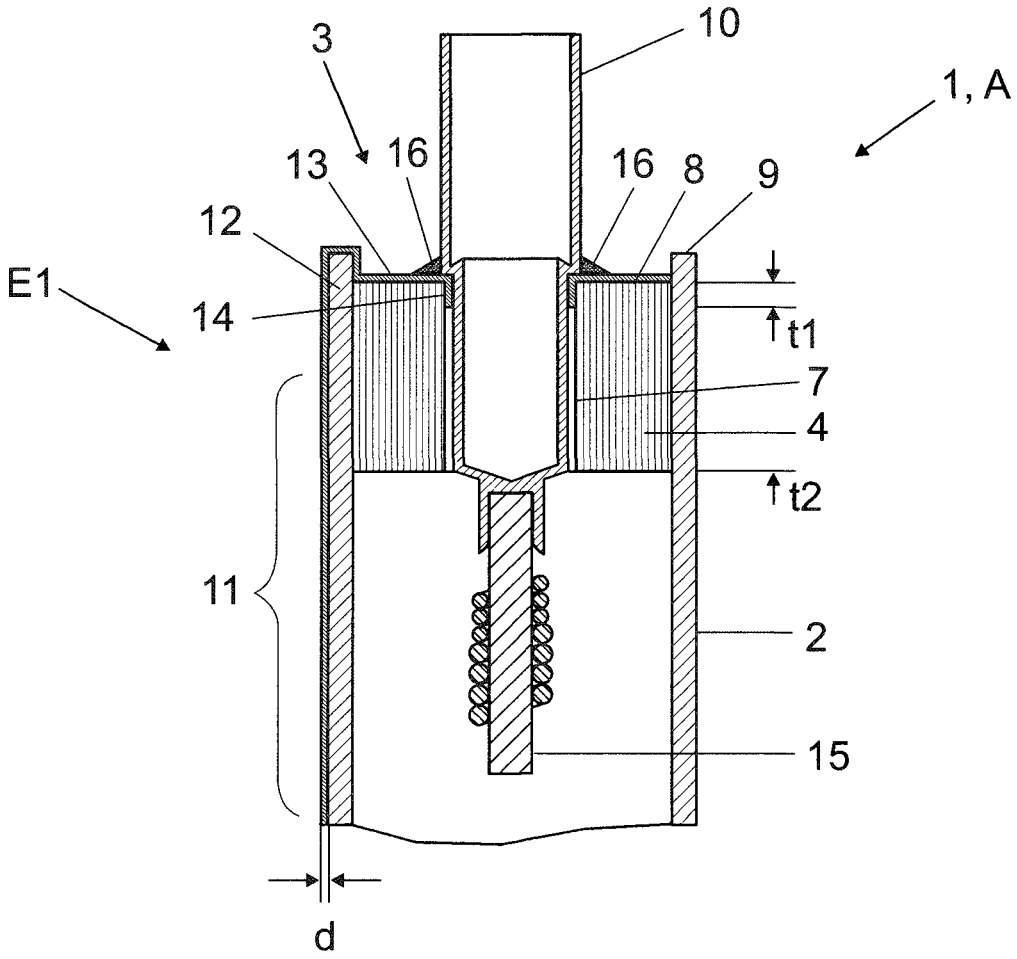
FIG. 5 shows the high-pressure gas discharge tube in accordance with the first embodiment as a sectional illustration in a side view using a detail A from one of the end regions.

FIG. 3 shows a view at an angle of the high-pressure gas discharge tube 1 in accordance with a first embodiment with the view looking onto the end region E1. FIG. 4 shows an enlarged view at an angle onto the end region E1 of the high-pressure gas discharge tube 1 in accordance with the first embodiment. FIG. 5 shows the high-pressure gas discharge tube 1 in accordance with the first embodiment as a sectional illustration in a side view in greater detail on the basis of the detail A shown in FIG. 2. In this case, the section passes longitudinally centrally through the high-pressure gas discharge tube 1 and in the process also through the connecting part 6.

The connecting part 6, starting from the ring 5, first runs as a comparatively thin connecting strip 11 longitudinally in the direction of the open end 3 of the end region E1 on the outer lateral surface of the discharge vessel 2. Shortly before reaching the ring-shaped end face 9, the connecting part 6 widens and runs over the protruding rim 12 of the discharge vessel 2, which protruding rim is formed on the ring-shaped end face 9. The connecting part 6 then runs further, as a first region 13, which completely covers the outer end face 8 of the stopper 4.

The first region 13 is adjoined by a second region 14, which extends, starting from the end face 8 of the stopper 4, in the form of a ring or tube into the stopper bore 7 by a predetermined depth t1. This depth t1 is in this case approximately 10% of the length of the stopper bore 7, which, given a length t2 of the stopper bore 7 of 3 mm, for example, corresponds to a depth t1 of approximately 0.3 mm.

A thickness d of the starting aid 7, in particular at least of the first region 13 and the second region 14, is in this case, for example, eight or twelve micrometers, to be precise even around the edges in the region of the protruding rim 12 and between the first region 13 and the second region 14.

In this case, the leadthrough 10 is in the form of a tube with a single step, with that end of said tube which adjoins the gas-filled space of the discharge vessel 2 being closed. At the closed end, an electrode 15 protruding into the gas-filled space of the discharge vessel 2 is fastened. The leadthrough 10 is inserted with its narrower section in the stopper bore 7 and protrudes with its wider section outward. The step between the two sections can act as a stop with respect to the stopper 4.

The leadthrough 10 is fuse-sealed into the stopper bore 7 by means of a glass solder 16. In this case, it makes electrical contact, at least locally, with the second region 14 of the connecting part 6. As a result, the leadthrough 10 and the starting aid 5, 6 are electrically connected to one another. The starting aid 5, 6 extends, by means of its second region 14, as far as into the stopper bore 7, for this purpose.

Figure 6:
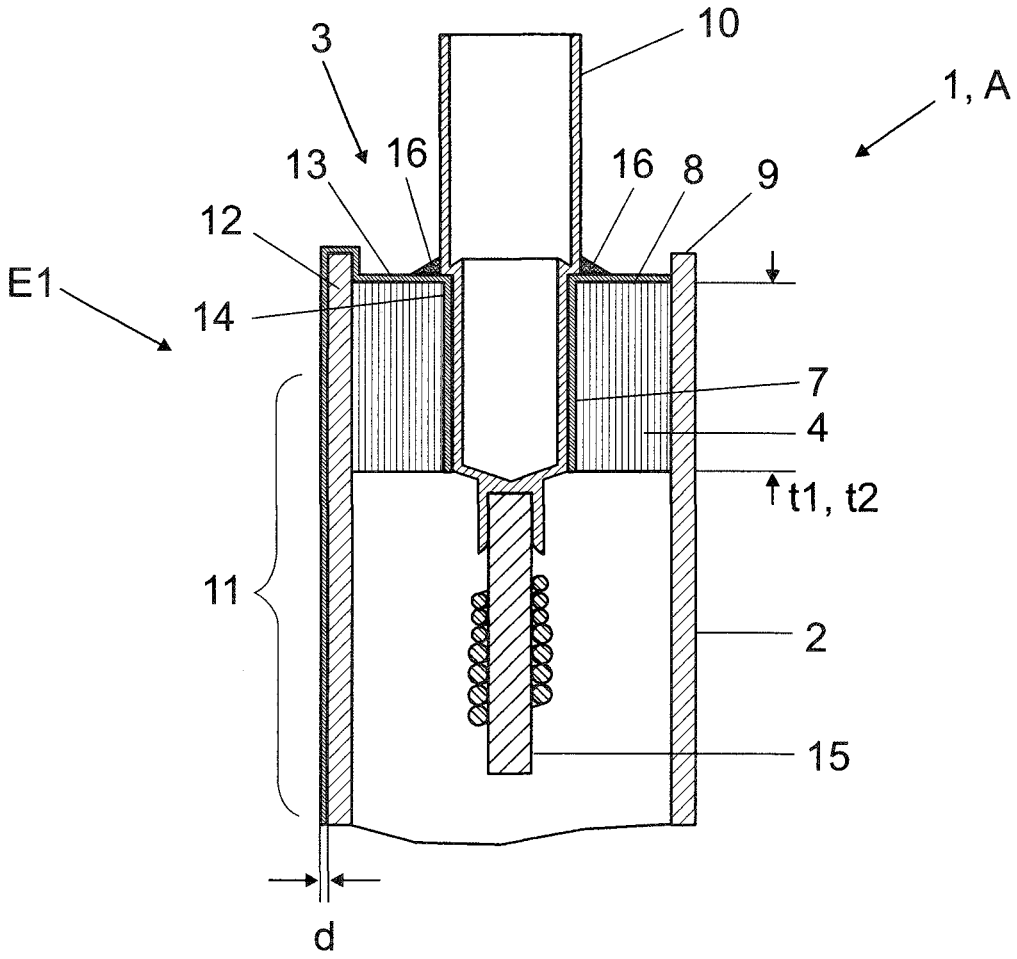
FIG. 6 shows a sectional illustration in a side view of a second embodiment of the high-pressure gas discharge tube shown in FIG. 2 using the detail A.

FIG. 6 shows a sectional illustration in a side view of a second embodiment of the high-pressure gas discharge tube 1 in a similar illustration to that in FIG. 5. In contrast to the first embodiment shown in FIG. 5, the second region 14 now has a depth t1 which extends over the entire length t2 of the stopper bore 7, with the result that, therefore, t1=t2.

Figure 7:
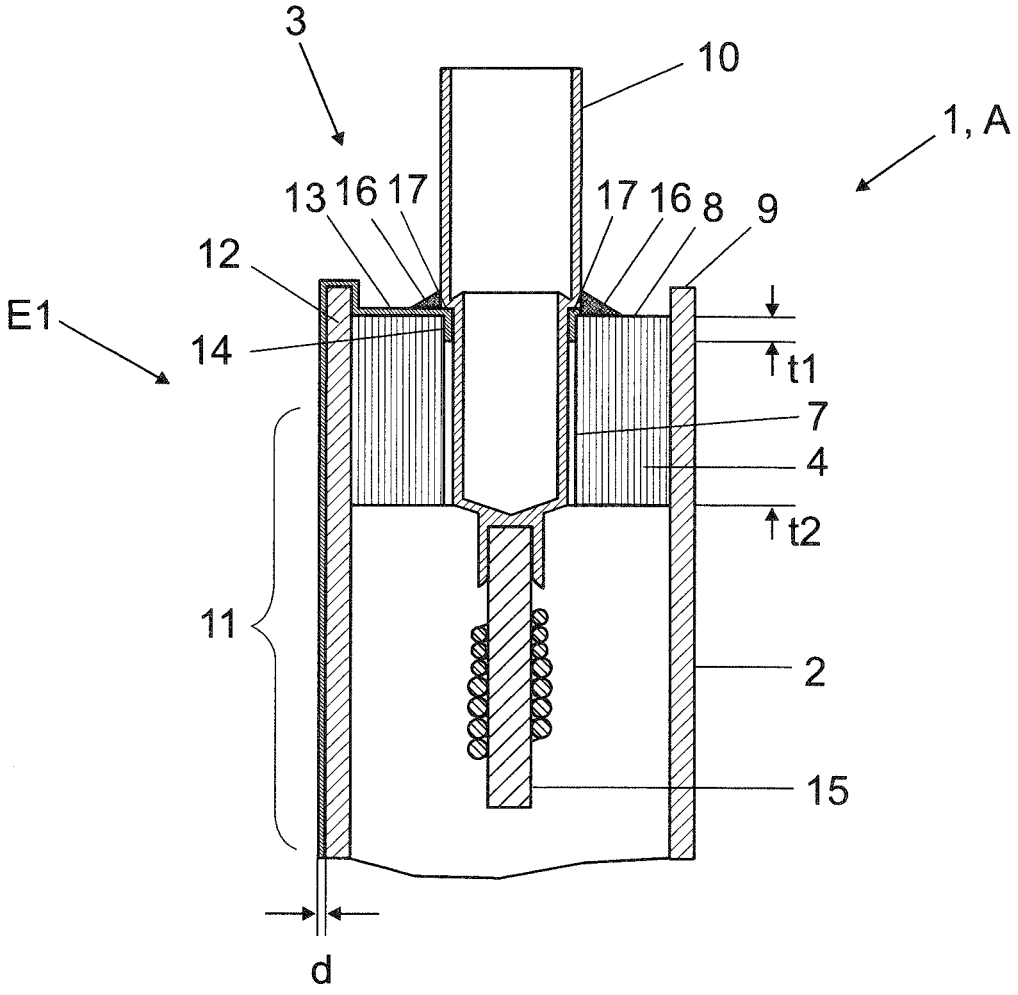
FIG. 7 shows a sectional illustration in a side view of a third embodiment of the high-pressure gas discharge tube shown in FIG. 2 on the basis of the detail A.

FIG. 7 shows a sectional illustration in a side view of a third embodiment of the high-pressure gas discharge tube 1 in an illustration similar to that in FIG. 5. The connecting part 6 now runs on the outer end face 8 of the stopper 4 as a strip-shaped first region 13 as far as the stopper bore 7. Directly at the stopper bore 7, the first region 13 has a ring-shaped ring region 17 surrounding the stopper bore 7.

In general, "a", "an" etc. can be understood to mean a singular or a plural, in particular in the sense of "at least one" or "one or more" etc., as long as this is not explicitly ruled out, for example by the expression "precisely one" etc.

Also, when a number is indicated, this can include precisely the indicated number and also a conventional tolerance range, as long as this is not explicitly ruled out.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

REFERENCE SYMBOLS

1 high-pressure gas discharge tube
2 discharge vessel
3 open end
4 stopper
5 ring-shaped starting strip
6 connecting part
7 stopper bore
8 outer end face of stopper
9 ring-shaped end face of discharge vessel
10 electrically conductive leadthrough
11 connecting strip
12 protruding rim of discharge vessel
13 first region of connecting part
14 second region of connecting part
15 electrode
16 glass solder
17 ring region
A section
d thickness
E1, E2 end region
G gas discharge lamp
K bulb
t1 depth of second region
t2 length of stopper bore

What is claimed is:

1. A gas discharge tube comprising a starting aid, comprising:

a discharge vessel with at least one open end, in which end a stopper with a continuous stopper bore is inserted; and an electrical leadthrough, which is inserted into the respective stopper bore and is fuse-sealed into the stopper bore;

wherein the starting aid extends at least into the stopper bore, wherein the starting aid has at least one starting strip applied to the outside of the discharge vessel and, on one side, a connecting part of the starting aid is formed from the starting strip at least into the stopper bore, wherein connecting part widens and runs over a protruding rim of the discharge vessel.

2. The gas discharge tube of claim 1, wherein the starting aid has a first region, which runs in the form of a ring sector around the stopper bore on an outer end face of the stopper, which first region is adjoined by at least one second region located in the stopper bore.

3. The gas discharge tube of claim 2, wherein the first region covers the full area of the outer end face of the stopper.

4. The gas discharge tube of claim 1, wherein the starting aid extends in the form of a tube into the stopper bore.

5. The gas discharge tube of claim 1, wherein the starting aid extends over the entire length of the stopper bore.

6. The gas discharge tube of claim 1, wherein the starting aid extends over no more than 50% of a length of the stopper bore.

7. The gas discharge tube of claim 6, wherein the starting aid extends over no more than 25% of a length of the stopper bore.

8. The gas discharge tube of claim 7, wherein the starting aid extends over no more than 10% of a length of the stopper bore.

9. The gas discharge tube of claim 8, wherein the starting aid has at least one starting strip applied to the outside of the discharge vessel and, on one side, a connecting part of the starting aid is formed from the starting strip as far as into the stopper bore; wherein the connecting part has a thickness with a value in the range of from one to thirty micrometers.

10. The gas discharge tube of claim 9, wherein the connecting part has a thickness with a value in the range of from five to fifteen micrometers.

11. The gas discharge tube of claim 10, wherein the connecting part has a thickness with a value in the range of from eight to twelve micrometers.

12. The gas discharge tube of claim 1, wherein the starting aid extends into the stopper bore by no more than 0.5 mm.

13. The gas discharge tube of claim 12, wherein the starting aid extends into the stopper bore by no more than 0.3 mm.

14. The gas discharge tube of claim 1, wherein a thickness of the starting aid in the stopper bore is between one and thirty micrometers.

15. The gas discharge tube of claim 14, wherein the thickness of the starting aid in the stopper bore is between ten and fifteen micrometers.

16. The gas discharge tube of claim 15, wherein the thickness of the starting aid in the stopper bore is twelve micrometers.

17. A gas discharge lamp, comprising: at least one gas discharge tube comprising a starting aid, comprising: a discharge vessel with at least one open end, in which end a stopper with a continuous stopper bore is inserted; and an electrical leadthrough, which is inserted into the respective stopper bore and is fuse-sealed into the stopper bore; wherein the starting aid extends at least into the stopper bore, wherein the starting aid has at least one starting strip applied to the outside of the discharge vessel and, on one side, a connecting part of the starting aid is formed from the starting strip at least into the stopper bore, wherein connecting part widens and runs over a protruding rim of the discharge vessel.

* * * * *